US008229670B2

(12) United States Patent
Byrne et al.

(10) Patent No.: US 8,229,670 B2
(45) Date of Patent: Jul. 24, 2012

(54) FLUIDS LIFTING TOOL

(76) Inventors: Paul Byrne, McKinney, TX (US); Phillip P. Harris, Perryton, TX (US)

( * ) Notice: Subject to any disclaimer, the term of this patent is extended or adjusted under 35 U.S.C. 154(b) by 365 days.

(21) Appl. No.: 12/605,233

(22) Filed: Oct. 23, 2009

(65) Prior Publication Data

US 2010/0106422 A1 Apr. 29, 2010

Related U.S. Application Data

(60) Provisional application No. 61/107,941, filed on Oct. 23, 2008.

(51) Int. Cl.
*E21B 47/00* (2012.01)

(52) U.S. Cl. ..... 702/6; 166/252.1

(58) Field of Classification Search ..... 702/6, 11–13, 702/50, 54, 55, 100, 130, 138, 140, 141, 702/158, 166; 166/250.01, 252.1, 252.2, 166/250.07, 250.15; 340/853.1, 854.1, 855.4; 367/81, 83

See application file for complete search history.

(56) References Cited

U.S. PATENT DOCUMENTS 5,597,042 A * 1/1997 Tubel et al. ..... 166/250.01
2003/0205375 A1* 11/2003 Wright et al. ..... 166/250.1

* cited by examiner

*Primary Examiner* — Manuel L Barbee

(74) *Attorney, Agent, or Firm* — Tomlinson Rust McKinstry Grable

(57) ABSTRACT

A fluids lifting tool and analysis system. The present invention comprises a fluid lifting system for a gas well. The system comprises a lifting tool positioned in the well and a docking station at the well surface. The tool includes a processor, pressure sensors, temperature sensors, an accelerometer, and a proximity sensor. A battery in the tool is adapted to be charged by inductive coupling using coils in the docking station and the tool. The tool is released from the docking station and descends the well. During descent the tool measures elapsed time, velocity of the tool, calculates distance traveled, measures pressure and temperature, determines volumes or oil and water in the well, and senses when the tool reaches the bottom of the well. The FLT chooses to ascend the well when appropriate and transfers measured and calculated data to the docking station.

20 Claims, 2 Drawing Sheets

FLUIDS LIFTING TOOL

CROSS REFERENCE TO RELATED APPLICATION

This application claims the benefit of U.S. Provisional Application No. 61/107,941, filed on Oct. 23, 2008, the contents of which are incorporated herein fully by reference.

FIELD OF THE INVENTION

The present invention relates generally to gas wells and particularly to a fluid lifting and analysis tool for use with gas wells.

SUMMARY OF THE INVENTION

The present invention is directed to a fluid lifting system for a gas well. The tool comprises a tool housing adapted to fit in a well pipe, a processor supported by the housing, a pressure sensor supported by the housing and electronically connected to the processor, an accelerometer supported by the housing and electronically connected to the processor, a proximity sensor supported by the housing and electronically connected to the processor, a battery supported by the housing, and a docking station adapted to be operatively connected to the tool housing.

In an alternative embodiment the present invention is further directed to a method for analyzing fluids in a gas well. The method comprises the steps of releasing a lifting tool housing from a docking station at a top of a well when the well is shut, measuring a time period the tool housing is disconnected from the docking station, measuring a velocity of the tool housing, calculating a distance of the tool housing from the docking station using the time period, the velocity, and a drag coefficient, sensing when the tool housing encounters a bottom of a layer of water, measuring a pressure of fluid in the well at the bottom of the layer of water, sensing when the tool housing encounters a bottom of a layer of oil, measuring a pressure of fluid in the well at the bottom of the layer of oil, sensing when the tool housing is at a bottom of the well, measuring a pressure of fluid in the well at the bottom of well, calculating a volume of water in the well using the measured pressure, and calculating a volume of oil in the well using the measured pressure.

DESCRIPTION OF THE INVENTION

Figure 1:
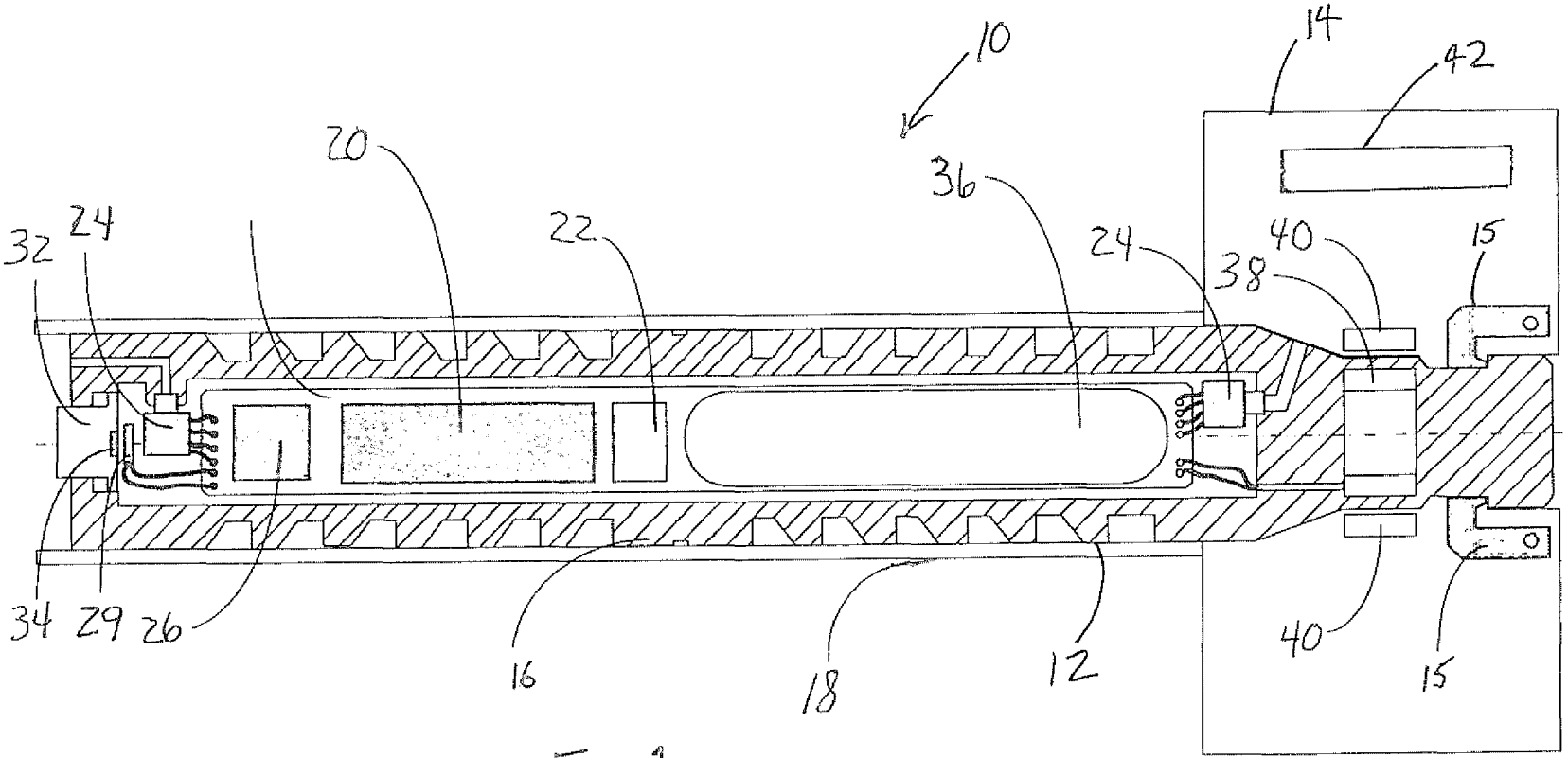
FIG. 1 is a side schematic representation of the fluid lifting tool built in accordance with the present invention.

Gas wells produce some additional fluids such as oil and water that reside in a well. In the case when the fluid build-up is so large that the gas is prevented (or significantly reduced) from rising to the surface in the well (due to the hydrostatic pressure of the oil and water), a lifting device known as a plunger is generally utilized to extract the unwanted fluids from the well. However, plungers have many shortcomings and do not gather information about the physical parameters of the well and the fluids in the well because they are steel rods containing no electronics or instrumentation.

The present invention comprises of a cylindrical body approximately the size of the inside diameter of the tubing of a gas well, in this case 0.190" diameter. It is the nature of gas wells to not only produce gas but also to produce oil and water in various ratios. This device is inserted into the well at its top and then the well is sealed. Instead of using a standard method of sealing, this invention (hereinafter known as Fluids Lifting Tool, or just FLT) is sealed with a device (which is part of this patent application) called a lubricator docking port.

After the lifting tool is inserted into the well and the well is sealed, the FLT falls to the bottom, some 10,000 feet is typical. As the FLT travels downward, sensors measure parameters of the well with the on-board computers. Rechargeable batteries power the FLT until it is brought back to the surface using normal oil field technology. When the FLT arrives at the top of the lubricator docking port, it is captured by this port. The port then negotiates with the FLT via inductive coupling transformer, where data, programming and operational instructions are shared. When the programming instructs the FLT to descend again, it falls to the bottom of the well and starts a new cycle.

The FLT is designed to provide the functionality of clearing fluids from the well, in addition to gathering and analyzing information concerning the characteristic of the well and the well fluids. Because of the embedded computer system, the following data and information can be gathered: 1) down hole temperature measurements, 2) down hole pressure measurements, 3) travel time from well surface to well bottom, 4) well bore tight spot locations (known as collars) and number thereof, 5) location of fluid top from the surface, 6) location of oil/water interface, 7) amount of water height and volume of water, 8) amount of oil height and volume of oil, 9) location of fluid/gas interface, 10) calculation of total hydrostatic fluids pressure, 11) travel time to surface from well bottom, 12) calculation of surface pressure necessary to lift or extract the fluids in the well, 13) automatic deferral of FLT ascent by the FLT if insufficient fluids have accumulated in the well, 14) automatic recharging of FLT batteries on arrival at the surface (using the lubricator docking port), 15) automatic data transfer from the FLT to surface computers via the lubricator docking port, 16) well data profiling whereby data can be collected from numerous locations from the top of the well to the bottom, 17) surface equipment can re-program the FLT to not only gather information but also operating procedures based on the well data measured by the FLT and not known by the surface computers, and 18) automatic transfer of optimization characteristics from surface computers to FLT so that gas production rates can be optimized.

With reference now to the drawings and to FIG. 1 in particular, shown therein is a preferred embodiment of the system 10 of the present invention. The system 10 comprises a fluid lifting tool or FLT 12 and a lubricating docking charge cradle or docking station 14. The FLT 12 comprises a tool housing 16 and is sized to fit within a well 18. Preferably, the housing 16 is comprised of a combination of material such as steel, alloys and plastics arranged so as to provide a sealed secure housing for the electronic and to obtain an optimum weight so that it can sink through the fluids but not too heavy to prevent fluid/gas pressures lifting the tool 12 to the surface. The FLT 12 further preferably comprises circuit board 19 for supporting a plurality of sensors and a processor 20 supported in the housing 16. Preferably, the sensors include an accelerometer 22 to measure a rate of acceleration of the FLT 12, pressure sensors 24 to measure the well pressures 18 on top of the FLT, the bottom of the FLT and along the side of the FLT, and temperature sensors 26 to measure the temperature in the well at the same locations. The FLT 12 also comprises a proximity sensor 28 to detect when the FLT has reached the bottom of the well 18. The sensors 22, 24, 26, and 28 are electronically connected to the processor 20 to communicate the measurements for processing by the processor.

The docking station 14 is disposed on the surface of the ground at the top of the well 18 at a location called "The Lubricator"; so named because this invention replaces the old standard lubricator with the new lubricator docking station. The docking station 14 is sized to receive or dock the tool housing 16, effectively maintaining the housing at the top of the well 18. Docking is achieved by a sensor detecting the arrival of the FLT 12. A docketing clamp 15 engages with the FLT 12 at its top and holds the FLT in place. A solenoid preferably acts as a clamp 15 release mechanism to allow the FLT 12 to go back down to the bottom of the well 18. In situations where there is a lot of sand, shale or other particles that would otherwise jam the clamp 15 mechanism, an electromagnet may be utilized to hold the FLT 12 in place.

The FLT 12 starts in a docked position in the docking lubricator 14 at the well 18 surface. When the surface pressure equipment closes the well 18 by closing well valves (not shown), the flow of gas in the well stops and the FLT 12 is released by the capture mechanism and clamp 15, at which point, the FLT starts its decent to the bottom of the well. The point at which the surface equipment decides to "shut the well in", as it as known, is determined by the volume of gas being produced. When the well 18 is shut in, there is now no flow against the FLT 12 and the tool starts its decent into the well. As the FLT 12 un-docks, it synchronizes an internal time clock within the processor 20 with the surface equipment time clock, which establishes a new base time known as well time. Now the surface equipment docking station 14 and the FLT have the same time base.

Preferably the FLT 12 will have been programmed by the surface equipment or an operator to gather the information required and the time interval (data collection rate) for this cycle. The FLT 12 has also been told how much fluid must be above it before it ascends to the surface. This is known as the fluids above tool, hereinafter known as FAT. Additionally, the specific gravity of the oil and water are also programmed into the FLT 12, and preferably based on previous samples taken on previous cycles of operation by the FLT.

As the FLT 12 falls in the well 18, it uses the descent equation:

$$s=(ut+(at^2)/2)k$$

where:

s=distance covered
u=initial velocity
t=time
a=gravitational acceleration
k=coefficient Generally, the well tubing is made of sections screwed together, and the joints between sections are called the collar joint or just collars. Because these collars have a small internal gap between the shoulders of the thread flange of sections of tubing, the collars represent a location where the FLT 12 can catch on the edge of the collars. As the FLT 12 encounters these collars it records the location of the collar by producing a collar table. The collar table records the event of a collar interaction (hereinafter known as a ping). Because the onboard computer knows that it is impossible for the collar to suddenly accelerate or decelerate by more that a few percentages, it can determine if a collar has been missed (no interaction) or an additional collar has been detected but is only interference or noise in the system. In other words, if a collar detection would indicate that the speed of the FLT 12 has suddenly doubled, it is probably noise. Conversely, if a collar is missed it is unlikely that the FLT 12 reduced its speed by 50%. Over several cycles, this collar table becomes very reliable at detecting the location of the collars. Because the length of each tubing section is known (typically 30 feet) the FLT 12 has the ability to not only measure the exact depth of the well 18, but can gather data at these locations and obtain a physical profile of the entire well. At these regular collar locations and intervals, the FLT 12 records the pressures from the pressure sensors 24 and the temperature from the temperature sensors 26, and calculates a current position of the FLT 12.

At some time during the descent, the FLT 12 encounters the top of the fluid layer. The onboard accelerometer 22, pressure transducers 24 and load cells within the FLT immediately inform the processor 20 that the top fluid layer has been reached. This is done by measuring a sudden deceleration of the FLT 12 and a sudden increase in pressure at the bottom of the FLT due to dynamic loading of the sensor 24. At this point, the top surface pressure (TSP) and temperature are recorded from the pressure sensor 24 and the temperature sensor 26. This pressure will later be recorded as the gas pressure above the fluids or GPAF.

As the FLT 12 falls further, the hydrostatic pressure is continuously monitored by the pressure sensors 24. As the FLT 12 falls through the oil layer there is a gradual increase in hydrostatic pressure above it. As the FLT 12 continues to fall through this layer it continually detects the pings from the collars to the water layer. In the water layer there is a sudden increase in the rate at which the hydrostatic pressure increases due to the increase in fluid density due to the additional water column. The height of the oil column is calculated by detecting the ping above the oil/gas interface and the previous known velocity of the FLT 12 (knowing the time between pings and the physical distance between collars) and the oil/water interface above the next detected ping. As it is unlikely that a ping will occur at these interfaces, the on-board processor 20 will use radiometric techniques based on last known velocities and velocity change profiles to ascertain the position of the two interfaces. As the interface between the oil and water is determined, the processor 20 calculates the height of the oil column by using standard mathematical relationships between pressure, height and density.

The FLT 12 continues to fall until the proximity sensor 28 is activated when the FLT reaches the bottom of the well 18. Preferably, the proximity sensor 28 comprises a magnet sensor 29 and probe 30 positioned proximately at the bottom end of the FLT 12. The probe 30 has a contact end 32 positioned outside of the tool housing 16 and a magnet end 34 disposed inside the tool housing. As the FLT 12 reaches the bottom of the well 18, the probe 30 is pushed into the body of the FLT housing 16. The magnet end 34 of the probe 30 is detected by a magnet sensor 29 disposed within the housing. When the sensor 29 detects the magnet end 34 of the probe 30, the processor 20 is notified signaling the arrival of the FLT 12 on bottom of the well 18. At this point, the FLT 12 processor 20 knows the exact number of collar joints from the top of the well 18 to the bottom and hence the exact depth of the well. It has also computed the height of the water column and the height of the oil column. As it measured the GPAF and can now measure the pressure at the bottom of the well 18, the well bottom pressure (WBP) or formation pressure is also known. The processor 20 now measures the bottom hydrostatic pressure above the tool using the equation:

$$p_{bottom}=p_{water}+p_{oil}+p_{tsp}$$

The total pressure due to the fluids is calculated as:

$$p_{total}=p_{bottom}-p_{tsp}$$

The height of the oil has been calculated above and as with the water height can now be calculated as well, and with the diameter of the pipe known (one of the parameters provided by the surface computer or operator), the volumes of the oil and water are now calculated.

The FLT 12 now uses the pressure transducers 24 to measure the bottom hole pressure and records the pressure in the processor. Because the FLT 12 cycles take only a few hours, the previous set of data generally does not differ much from the current cycle data. The FLT 12 now can compute the trend of these variables to calculate the most likely values for optimum production rates.

Both the surface computer and the FLT 12 processor 20 work from the same data from the previous cycling results and the trend analysis. Both computers know what the optimum surface pressure needs to be when the surface valve is opened again to bring the FLT 12 and the fluids riding on top of it, to start producing gas again.

Figures 2, 3:
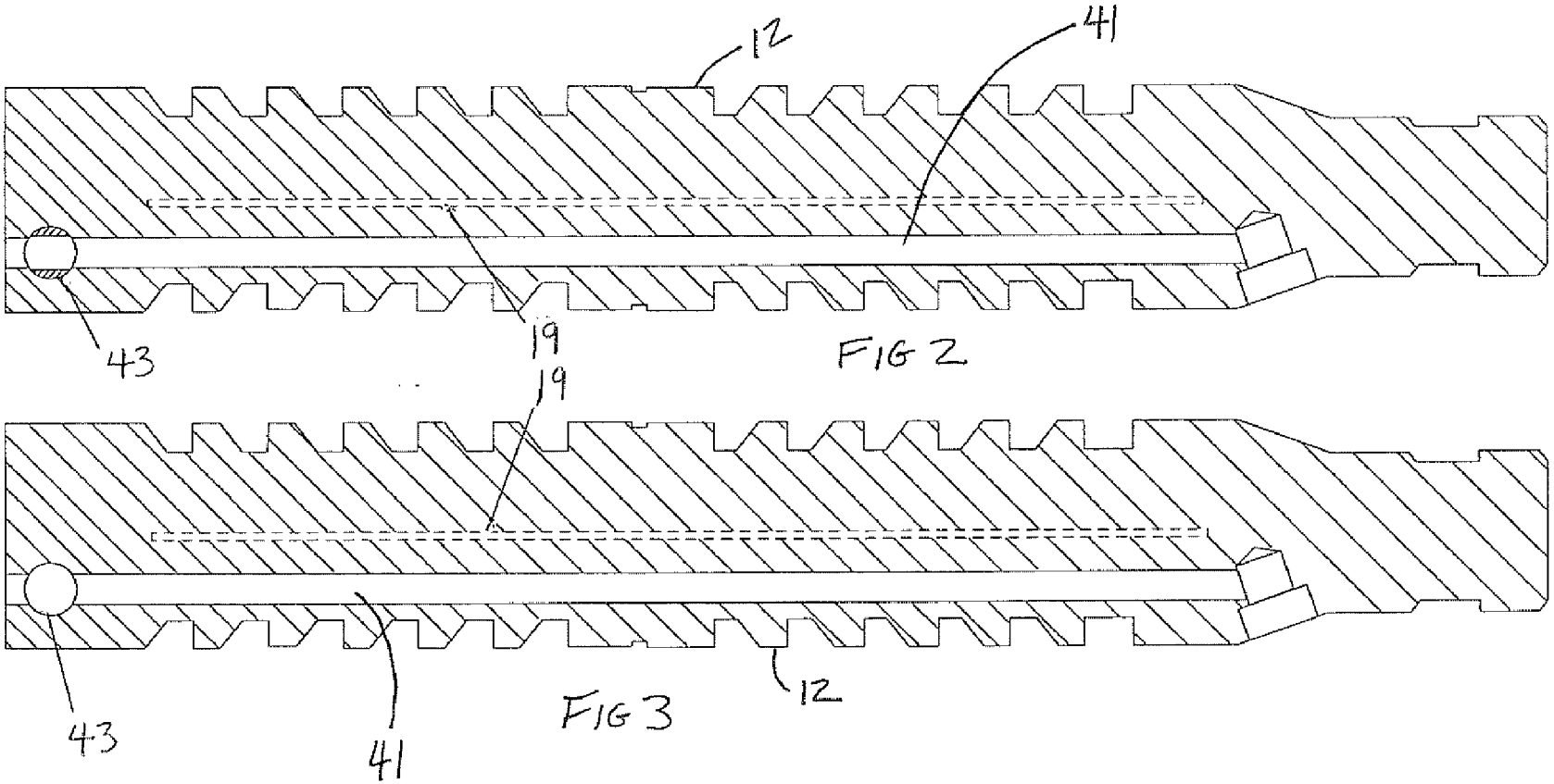
FIG. 2 shows a partial cutaway of the fluid lifting tool of FIG. 1 showing the bypass columns with the bypass baffles open.
FIG. 3 partial cutaway from FIG. 2 showing the bypass columns with the bypass baffles closed.

As the FLT 12 knows the pressure distributions between gas and all of the fluids, the FLT can decide not to rise to the surface if the level of fluids above it are too small. The FLT 12 can control its ascent or descent by allowing fluid to pass through a plurality of bypass columns 41, as shown in FIGS. 2 and 3. Preferably three columns 41 are disposed circumferentially around a length of the housing 16. Fluid is allowed through the bypass columns 41 by opening a series of bypass baffles 43. Preferably, the bypass baffles 43 comprise an operable ball valve. When open (shown in FIG. 2), the bypass baffles 43 allows gas and fluids to pass through the FLT 12 so that the FLT can remain on the bottom of the well. When the desired fluid levels are above the FLT 12, it closes the bypass 41 (as shown in FIG. 3) and pressure beneath the FLT causes the FLT to return to the surface if the surface equipment has opened the surface valves. Because the FLT 12 never returns to the surface without the required fluid payload, it never crashes into the top assembly of the well 18, a common occurrence with the older style plunger system. When the FLT 12 eventually docks with the surface equipment, the system immediately enters into a data transfer & charge cycle (DTC cycle).

Data Transfer & Charge Cycle

Inside the top of the FLT 12 there is a magnetic coil 38. The surface equipment and docking station 14 has a corresponding outer coil 40 that surrounds the inner coil 38 of the FLT 12 when docked. It is now possible to charge the FLT 12 batteries 36 by a process known as induction coupling. As current in the outer coil 40 oscillates, it induces current in the inner coil 38 thus providing charge current to the FLT 12 batteries 36.

Data transfer is accomplished first by the surface equipment initiating a charge period. After the FLT 12 and the surface equipment processor 42 have completed the charging cycle, the surface equipment will intermittently discontinue the charge current with a know time, duty cycle and bit pattern. The pulsing of the charging current of the outer coil 40 is recognized by the FLT 12 as a request for data.

The FLT 12 communicates with the surfacing processor 42 by disconnecting the charging process in a known time, duty cycle and bit pattern. This information is known and recognized by the surface processor 42 as data from the FLT 12. As the FLT 12 and the surface processor 42 now have established a hand shaking communications protocol, data and configuration information can now be exchanged between them. At the end of the data transfer, the charging of the FLT 12 batteries 36 is reestablished. When a full charge is detected by the FLT 12 and communicated to the surface processor 42, the surface readies the FLT for the beginning of another cycle.

In situations where the well 18 has a slight curve to it due to directional drilling techniques being adopted when it was drilled, another section of the FLT 12 may contain a small propulsion assembly consisting of a small propeller. This propulsion system will be adopted to an almost all plastic construction or small amount of metal. Here, the FLT 12 falls to the gas/oil interface. On arrival, the on-board sensors detect the interface as before but now drive the FLT 12 through the fluids as the buoyancy forces would prevent a high velocity through the fluids if the propulsion system was not activated. This embodiment will allow the FLT 12 to travel along a horizontal section of tubing and make measurements otherwise impossible. Because of the very light construction of this embodiment, very low bottom hole gas pressures will be able to lift the FLT 12, thus producing more production gas in less time.

Various modifications can be made in the design and operation of the present invention without departing from its spirit. Thus, while the principal preferred construction and modes of operation of the invention have been explained in what is now considered to represent its best embodiments, it should be understood that within the scope of the appended claims, the invention may be practiced otherwise than as specifically illustrated and described.

What is claimed is:

1. A fluid lifting system for a gas well, the tool comprising:
- a tool housing adapted to fit in a well pipe;
- a processor supported by the housing;
- a pressure sensor supported by the housing and electronically connected to the processor;
- an accelerometer supported by the housing and electronically connected to the processor;
- a proximity sensor supported by the housing and electronically connected to the processor;
- a battery supported by the housing;
- a docking station adapted to be operatively connect to the tool housing;
- an outer charge coil; and
- an inner coil supported by the housing proximate the battery;
- such that when a current oscillates in the outer coil a current is induced in the inner coil.

2. The system of claim 1 further comprising a temperature sensor supported by the housing and electronically connected to the processor.

3. The system of claim 1 wherein the proximity sensor comprises:
- a probe having a contact end and a magnetic end, the probe movably supported proximate a bottom portion of the tool housing; and
- magnet sensor electronically connected to the processor, the magnet sensor adapted to detect the magnet end of the probe;
- wherein the probe is positioned such that the contact end will contact a bottom of a well when the tool housing is proximate the bottom of the well.

4. The system of claim 1 where in the pressure sensor comprises a pressure transducer.

5. The system of claim 1 wherein the housing further comprises a bypass baffle adapted to allow fluids to pass through the fluid lifting system.

6. The system of claim 5 wherein the bypass baffle is operable between a closed position and a plurality of open positions.

7. The system of claim 1 wherein the processor is adapted to communicate data to the docking station when the housing is operatively connected to the docking station.

8. The system of claim 1 wherein the outer charge coil is located at the docking station.

9. The system of claim 1 wherein the processor is adapted to calculate a volume and composition of fluid present in the well.

10. The system of claim 1 wherein the processor is adapted to calculate a velocity of the housing.

11. The system of claim 1 wherein the processor is adapted to determine when the housing is proximate a bottom of the gas well.

12. A fluid lifting system for a gas well, the tool comprising:

a tool housing adapted to fit in a well pipe;

a processor supported by the housing;

a pressure sensor supported by the housing and electronically connected to the processor;

an accelerometer supported by the housing and electronically connected to the processor;

a proximity sensor supported by the housing and electronically connected to the processor;

a battery supported by the housing; and a docking station adapted to be operatively connect to the tool housing;

wherein the processor is adapted to calculate a volume of water present in the well.

13. The system of claim 12 further comprising an inner charge coil supported by the housing proximate the battery; and wherein the docking station further comprises an outer charge coil;

such that when a current oscillates in the outer coil a current is induced in the inner coil.

14. The system of claim 12 wherein the processor is adapted to calculate a distance between the tool housing and the docking station.

15. The system of claim 12 further comprising:

an outer charge coil; and an inner coil supported by the housing proximate the battery;

such that when a current oscillates in the outer coil a current is induced in the inner coil.

16. A fluid lifting system for a gas well, the tool comprising:

a tool housing adapted to fit in a well pipe;

a processor supported by the housing;

a pressure sensor supported by the housing and electronically connected to the processor;

an accelerometer supported by the housing and electronically connected to the processor;

a proximity sensor supported by the housing and electronically connected to the processor;

a battery supported by the housing; and a docking station adapted to be operatively connect to the tool housing;

wherein the processor is adapted to calculate a volume of oil present in the well.

17. The system of claim 16 wherein the processor is adapted to calculate a volume of water present in the well.

18. The system of claim 17 wherein the processor is adapted to communicate data to the docking station when the housing is operatively connected to the docking station.

19. The system of claim 16 wherein the proximity sensor comprises:

a probe having a contact end and a magnetic end, the probe movably supported proximate a bottom portion of the tool housing; and magnet sensor electronically connected to the processor, the magnet sensor adapted to detect the magnet end of the probe;

wherein the probe is positioned such that the contact end will contact a bottom of a well when the tool housing is proximate the bottom of the well.

20. The system of claim 16 further comprising:

an outer charge coil; and an inner coil supported by the housing proximate the battery;

such that when a current oscillates in the outer coil a current is induced in the inner coil.

* * * * *